US011992743B2

(12) United States Patent
Soller et al.

(10) Patent No.: US 11,992,743 B2
(45) Date of Patent: May 28, 2024

(54) EXERCISE APPARATUS AND METHODS OF STORING SAME

(71) Applicant: Expectations, LLC, Bonney Lake, WA (US)

(72) Inventors: Nicholas M. Soller, Orting, WA (US); Christopher H. Leier, Lake Tapps, WA (US); Darrin M. Swagel, St. Louis Park, MN (US)

(73) Assignee: Expectations, LLC, Bonney Lake, WA (US)

( * ) Notice: Subject to any disclaimer, the term of this patent is extended or adjusted under 35 U.S.C. 154(b) by 0 days.

(21) Appl. No.: 17/836,178

(22) Filed: Jun. 9, 2022

(65) Prior Publication Data

US 2023/0398424 A1 Dec. 14, 2023

(51) Int. Cl.
*A63B 71/00* (2006.01)
*A63B 23/02* (2006.01)

(52) U.S. Cl.
CPC ..... *A63B 71/0036* (2013.01); *A63B 23/0205* (2013.01)

(58) Field of Classification Search
CPC ..... A63B 71/0036; A63B 23/02–0238
See application file for complete search history.

(56) References Cited

U.S. PATENT DOCUMENTS 5,203,755 A * 4/1993 Kaiser ..... A63B 23/0227 482/142
6,213,924 B1 * 4/2001 Kaiyoorawongs ..... A63B 22/14 482/79
6,260,866 B1 * 7/2001 Cheng ..... B62K 3/002 280/87.041
6,428,021 B1 * 8/2002 Tung ..... B62K 15/006 280/87.041
6,685,603 B1 * 2/2004 Teeter ..... A61H 1/0218 482/141
7,179,213 B1 * 2/2007 Kuo ..... A63B 21/4047 482/907
7,311,645 B1 * 12/2007 Lynch ..... A63B 21/0552 482/121
11,052,280 B1 * 7/2021 Massner ..... A63B 21/0428
2005/0075226 A1 * 4/2005 Kuo ..... A63B 23/0222 482/130
2011/0045955 A1 * 2/2011 Savane ..... A63B 22/0056 482/52

(Continued)

OTHER PUBLICATIONS

Teeter, Dex II Decompression & Extension Assembly & Use Instructions, 16 pages, 2021.

*Primary Examiner* — Nyca T Nguyen
(74) *Attorney, Agent, or Firm* — Dicke, Billig & Czaja, PLLC

(57) ABSTRACT

A method of storing an exercise apparatus by moving the exercise apparatus from an apparatus use position into an apparatus storage position comprises releasing a mast relative to a frame and moving the mast from an upward, mast use position to a downward, mast storage position proximate the frame positioned on a support surface. The method can also include releasing a post relative to the mast from a post use position to a post storage position, and/or releasing a handle relative to the frame and moving the handle from a handle use position to a handle storage position proximate the frame.

19 Claims, 9 Drawing Sheets

(56) References Cited

U.S. PATENT DOCUMENTS

| | | | | |
|---|---|---|---|---|
| 2013/0331232 | A1* | 12/2013 | Kwo | A63B 1/00 482/38 |
| 2015/0375036 | A1* | 12/2015 | Ho | A63B 21/068 482/140 |
| 2018/0353798 | A1* | 12/2018 | Chung | A63B 71/0036 |
| 2020/0156728 | A1* | 5/2020 | Mazoyer | B62K 21/24 |

* cited by examiner

EXERCISE APPARATUS AND METHODS OF STORING SAME

BACKGROUND

Exercise apparatus generally include a frame and a user support configured and arranged to support a user for performing various exercises such as inversion and core training (e.g., hip supported inversion, back extensions, dips, abdominal crunches, bicep curls, stretches, etc.). An example of a known exercise apparatus is the DEX II inversion and core training system by TEETER of Bonney Lake, Washington. This exercise apparatus can be used as an inversion apparatus by pivoting from an upright position into an inverted position and, to pivot back into the upright position, the user can push on the cane-shaped handles to "walk" back into the upright position. While inverted, the user can push on the traction handles to attain a deeper decompressive stretch. The user can also use the handles for various core training exercises. Such exercise apparatus can take up valuable space and, therefore, it is desirable to reconfigure the apparatus into a more compact configuration so that it can be slid under a bed, couch, or the like for storage during nonuse.

For the reasons stated above and for other reasons stated below, which will become apparent to those skilled in the art upon reading and understanding the present specification, there is a need in the art for exercise apparatus and methods of storing same.

SUMMARY

The above-mentioned problems associated with prior devices are addressed by embodiments of the disclosure and will be understood by reading and understanding the present specification. The following summary is made by way of example and not by way of limitation. It is merely provided to aid in understanding some of the aspects of the invention.

In one embodiment, a method of storing an exercise apparatus by moving the exercise apparatus from an apparatus use position into an apparatus storage position comprises releasing a mast relative to a frame and moving the mast from an upward, mast use position to a downward, mast storage position proximate the frame positioned on a support surface.

In one embodiment, a method of storing an exercise apparatus by moving the exercise apparatus from a use position into a storage position comprises releasing a mast relative to a frame and moving the mast from an upward, mast use position to a downward, mast storage position proximate the frame positioned on a support surface; releasing a post relative to the mast from a post use position to a post storage position; and releasing a handle relative to the frame and moving the handle from a handle use position to a handle storage position proximate the frame.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. In accordance with common practice, the various described features are not drawn to scale but are drawn to emphasize specific features relevant to the present disclosure. Reference characters denote like elements throughout the Figures and the text.

DETAILED DESCRIPTION

Figure 1:
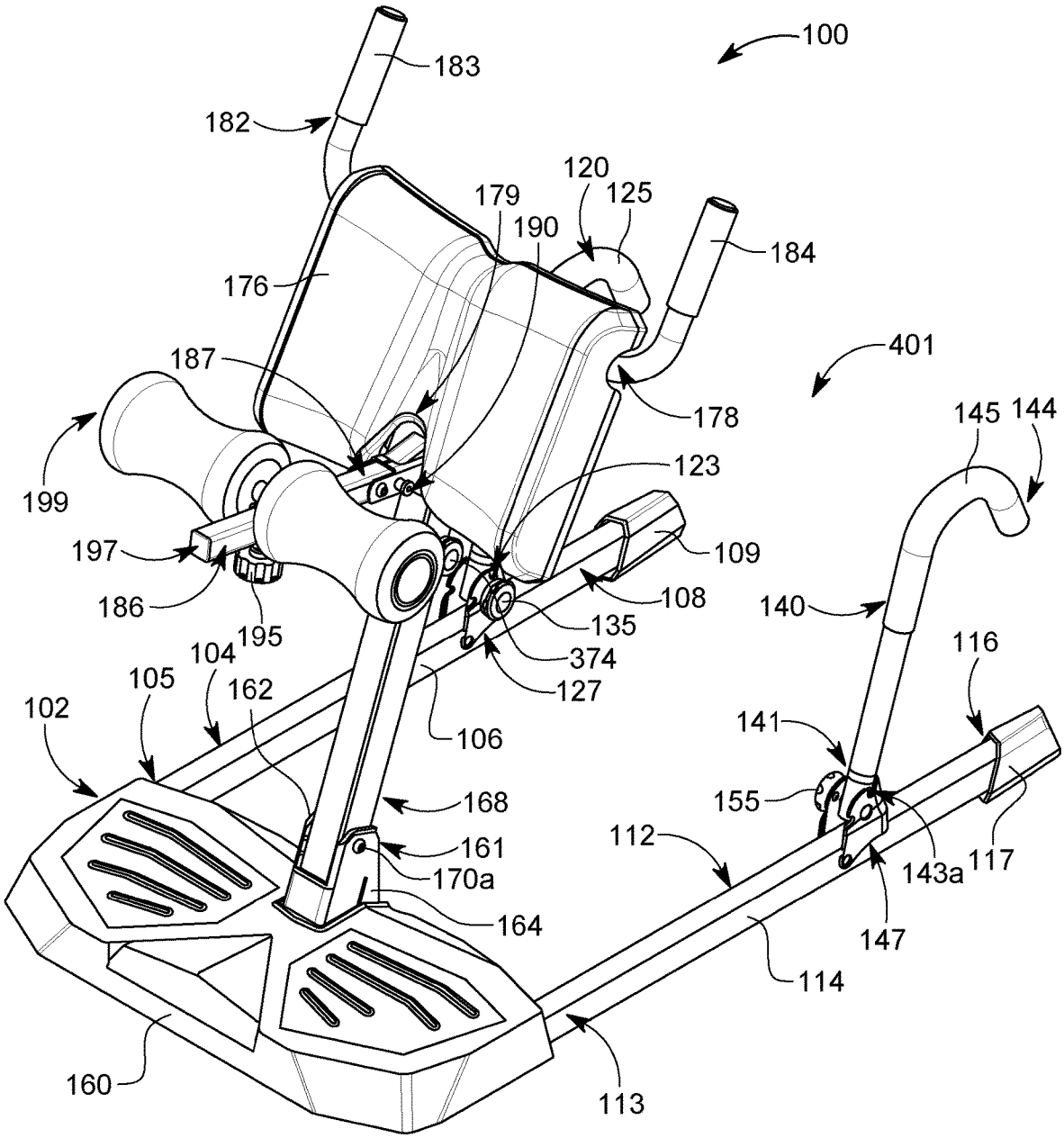
FIG. 1 is a front perspective view of an embodiment exercise apparatus constructed in accordance with the principles of the present invention.
Figure 2:
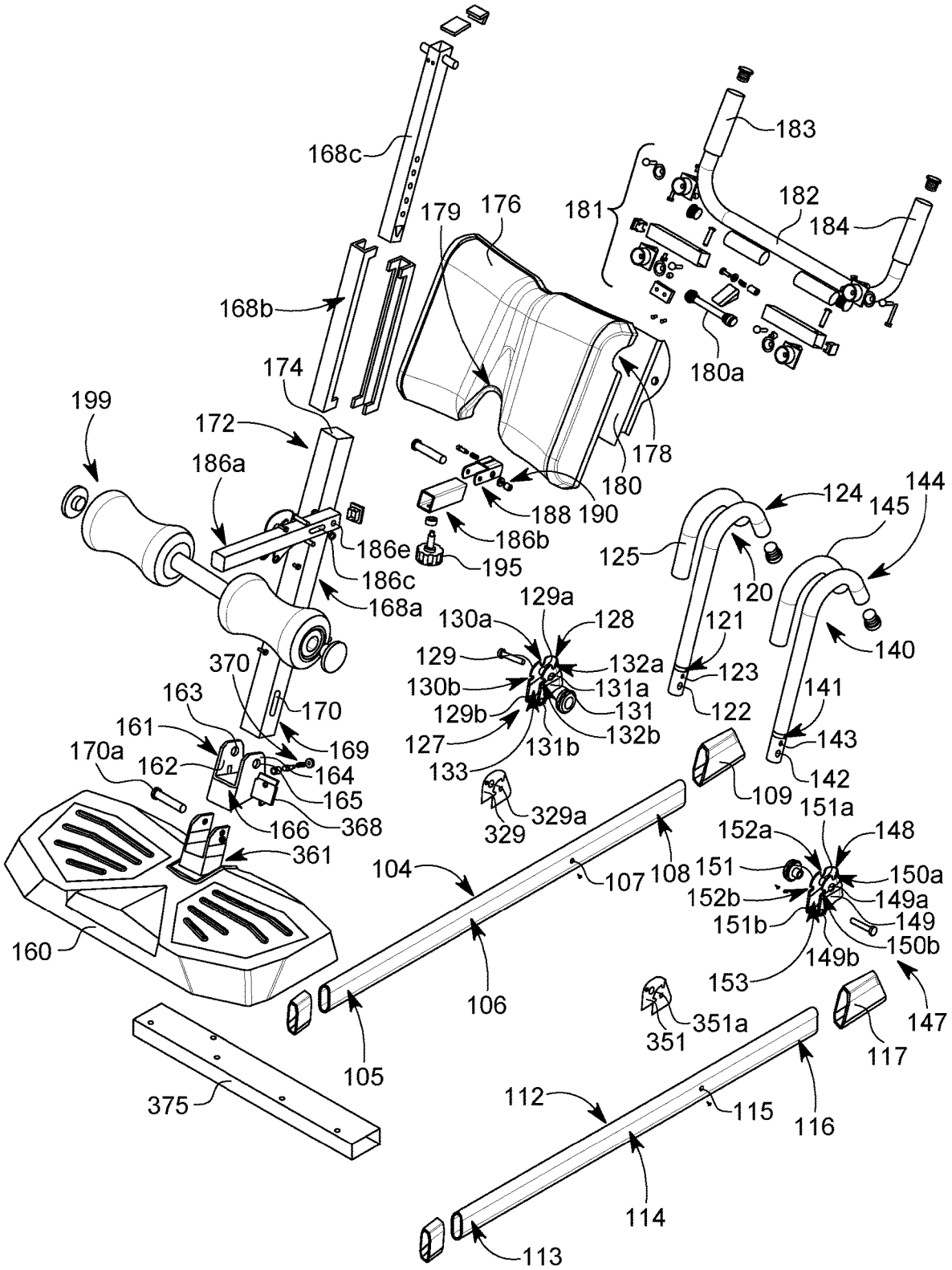
FIG. 2 is an exploded front perspective view of the exercise apparatus shown in FIG. 1.
Figure 3:
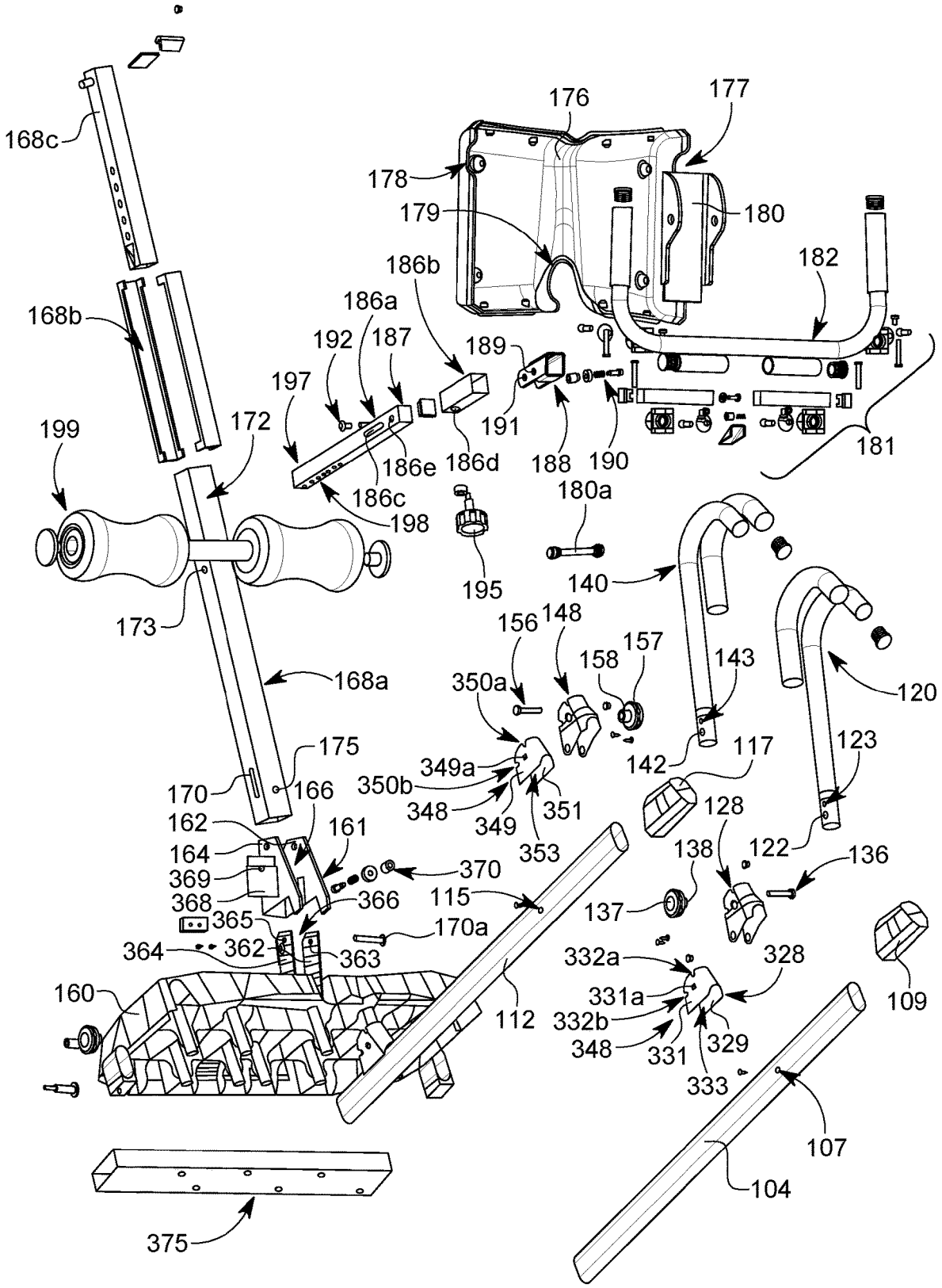
FIG. 3 is an exploded rear perspective view of the exercise apparatus shown in FIG. 1.

In the following detailed description, reference is made to the accompanying drawings, which form a part hereof, and in which is shown by way of illustration embodiments in which the disclosure may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that other embodiments may be utilized and mechanical changes may be made without departing from the spirit and scope of the present disclosure. The following detailed description is, therefore, not to be taken in a limiting sense.

Embodiments of the disclosure generally provide an exercise apparatus configured and arranged to be easily reconfigured between a use position and a storage position for storage, for example under a bed, a couch, etc. For example, one or more frame components can be reconfigured (e.g., pivot downward) from a use position into a more compact configuration proximate a support surface, such as a floor, for storage. In one example, a method of storing an exercise apparatus by moving the exercise apparatus from an apparatus use position into an apparatus storage position comprises releasing a mast relative to a frame and moving the mast from an upward, mast use position to a downward, mast storage position proximate the frame positioned on a support surface. The method can also include releasing a post relative to the mast from a post use position to a post storage position, and/or releasing a handle relative to the frame and moving the handle from a handle use position to a handle storage position proximate the frame.

In one embodiment, illustrated in FIGS. 1-8B, an exercise apparatus 100 includes a frame, which includes a base 102 comprising a platform 160 and a support 375 interconnecting a first leg 104 and a second leg 112, which are supported by a support surface S such as a floor. The first leg 104 includes an intermediate portion 106 interconnecting a proximal end 105 and a distal end 108. The intermediate portion 106 includes a bore 107, and a foot 109 is connected to the distal end 108. The second leg 112 includes an intermediate portion 114 interconnecting a proximal end 113 and a distal end 116. The intermediate portion 114 includes a bore 115, and a foot 117 is connected to the distal end 116.

The frame also includes handles 120 and 140 connected to respective legs 104 and 112, a mast 168 connected to the support 375 and the platform 160, user supports (lap pad assembly 176 and bolster pad assembly 199) connected to the mast 168, and a handle assembly 181 connected to the lap pad assembly 176.

A first cane-shaped handle 120 is connected to the first leg 104 with a connector assembly 127. The first handle 120 includes a proximal end 121 through which bores 122 and 123 extend. Bore 123 is configured and arranged to receive a detent assembly (not shown) that preferably partially extends outward from an outer-facing side of the first handle 120. A handle grip 125 is connected to a distal end 124 of the first handle 120. The connector assembly 127 includes a bracket 128, which is generally U-shaped to form a cavity 133 and includes an outer side 129 with bores 129*a* and 129*b* and notches 130*a* and 130*b* and an inner side 131 with bores 131*a* and 131*b* and notches 132*a* and 132*b*. The proximal end 121 of the first handle 120 is received within the cavity 133. A derattler assembly 135 includes a threaded fastener 136 that extends through the bores 129*a*, 122, and 131*a* to pivotally connect the first handle 120 to the bracket 128, and a knob 137 includes a threaded receiver 138 that threadably mates with the threaded fastener 136 to secure the threaded fastener 136 to the bracket 128 and the first handle 120. Preferably, the bracket 128 is configured and arranged to deflect so that, as the knob 137 is tightened, the bracket 128 tightens against the first handle 120 to reduce rattling. Optionally, a bushing 328 can be used between the bracket 128 and the first handle 120 to reduce wear on the first handle 120 when the knob 137 is loosened and increase friction on the first handle 120 when the knob 137 is tightened. The bushing 328, which is also generally U-shaped to form a cavity 333 in which the proximal end 121 of the first handle 120 is received, includes an outer side 329 with a bore 329*a* and an inner side 331 with a bore 331*a* corresponding to those of the bracket 128. The bushing 328 can also include notches 332*a* and 332*b* corresponding with those of the bracket 128. The detent assembly selectively engages the notch 130*a* to position the first handle 120 in a use position or selectively engages the notch 130*b* to position the first handle 120 in a storage position. A fastener extends through the bores 129*b*, 107, and 131*b* to connect the bracket to the first leg 104.

A second cane-shaped handle 140 is connected to the second leg 112 with a connector assembly 147. The second handle 140 includes a proximal end 141 through which bores 142 and 143 extend. Bore 143 is configured and arranged to receive a detent assembly 143*a* that preferably partially extends outward from an outer-facing side of the second handle 140. A handle grip 145 is connected to a distal end 144 of the second handle 140. The connector assembly 147 includes a bracket 148, which is generally U-shaped to form a cavity 153 and includes an outer side 149 with bores 149*a* and 149*b* and notches 150*a* and 150*b* and an inner side 151 with bores 151*a* and 151*b* and notches 152*a* and 152*b*. The proximal end 141 of the second handle 140 is received within the cavity 153. A derattler assembly 155 includes a threaded fastener 156 that extends through the bores 149*a*, 142, and 151*a* to pivotally connect the second handle 140 to the bracket 148, and a knob 157 includes a threaded receiver 158 that threadably mates with the threaded fastener 156 to secure the threaded fastener 156 to the bracket 148 and the second handle 140. Preferably, the bracket 148 is configured and arranged to deflect so that, as the knob 157 is tightened, the bracket 148 tightens against the second handle 140 to reduce rattling. Optionally, a bushing 348 can be used between the bracket 148 and the second handle 140 to reduce wear on the second handle 140 when the knob 157 is loosened and increase friction on the second handle 140 when the knob 157 is tightened. The bushing 348, which is also generally U-shaped to form a cavity 353 in which the proximal end 141 of the second handle 140 is received, includes an outer side 349 with a bore 349*a* and an inner side 351 with a bore 351*a* corresponding to those of the bracket 148. The bushing 348 can also include notches corresponding with those of the bracket 148. The detent assembly 143*a* selectively engages the notch 150*a* to position the second handle 140 in a use position or selectively engages the notch 150*b* to position the second handle 140 in a storage position. A fastener extends through the bores 149*b*, 115, and 151*b* to connect the bracket to the second leg 112.

The platform 160 is configured and arranged to support a user's feet and is preferably reinforced by a support 375 interconnecting legs 120 and 140. Bracket 161 interconnects the support 375 and the mast 168. The bracket 161 is generally U-shaped and includes a first side 162 with aperture 163 and a second side 164 with aperture 165. The sides 162 and 164 form a cavity 166 therebetween configured and arranged to receive the mast 168. Optionally, a bushing 361 can be positioned within the cavity 166. The bushing 361 is generally U-shaped and includes a first side 362 with aperture 363, which aligns with aperture 163, and a second side 364 with aperture 365, which aligns with aperture 165. The sides 362 and 364 form a cavity 366 therebetween configured and arranged to receive the mast 168. A plate 368 is positioned between the sides 162 and 164, and is preferably welded to the sides 162 and 164, and includes an aperture 369. A spring plunger 370 is operatively connected to the plate 368 and a spring-biased shaft 371 of the spring plunger 370 extends through the aperture 369.

The mast 168 preferably includes a base portion 168*a* and an extension portion 168*c*. Optionally, a bushing portion 168*b* can be used. The bushing portion 168*b* is inserted into a bore 174 of the base portion 168*a* proximate the base portion's distal end 172 and assists the extension portion 168*c* in moving within the bore 174 relative to the base portion 168*a*. The proximal end 169 of the base portion 168*a* includes a slot 170 extending through opposing sides that align with the apertures 163, 363, 365, and 165 and a fastener 170*a* extends therethrough to connect the base portion 168*a* to the bracket 161 and optional bushing 361.

The proximal end 169 also includes an aperture 175 in a rear side interconnecting the opposing sides including the slot 170. The aperture 175 is configured and arranged to selectively receive the shaft 371 of the spring plunger 370. An intermediate portion 171 of the base portion 168*a* includes an aperture 173 in the rear side proximate the distal end 172. The aperture 173 is configured and arranged to receive a shaft of an adjuster knob 374, which extends therethrough to selectively extend through a desired aperture of the extension portion 168*c*.

A lap pad assembly 176 is operatively connected to the extension portion 168*c*, a handle bar 182, and a post 186. The lap pad assembly 176 includes opposing notches 177 and 178 through which portions of the handle bar 182 extend, and a bracket assembly 181 interconnects the lap pad assembly 176 and the handle bar 182. Distal ends of the handle bar 182 include grips 183 and 184. A bottom of the lap pad assembly 176 includes a notch 179 through which the mast 168 extends. A bracket assembly 180 is operatively connected to the lap pad assembly 176 and a shaft 180*a* pivotally interconnects the bracket assembly 180 and the distal end of the extension portion 168*c*.

A bracket 188 is operatively connected, preferably by welding, to the bracket assembly 180. The bracket 188 includes opposing sides forming a cavity therebetween, and the sides form a bore 191 proximate their distal ends and a bore 189 proximate their proximal ends. A post 186 includes a first portion 186*a* positioned within the cavity and operatively connected to the bracket 188. A proximal end 187 of the first portion 186*a* includes a slot 186*c*, which aligns with bore 191, and an aperture 186*e*, which selectively aligns with bore 189. A fastener 192 extends through the bore 191 and the slot 186*c*, slidably interconnecting the first portion 186*a* to the bracket 188, and a spring plunger 190 is operatively connected to the bracket 188 and includes a shaft configured and arranged to extend through the bore 189 and selectively extend through the aperture 186*e* to secure the first portion 186*a* to the bracket 188.

The first portion 186*a* includes a plurality of apertures 198 on a bottom side proximate its distal end 197. The post 186 also includes a second portion 186*b* configured and arranged to receive and slide relative to the first portion 186*a*. A bottom side of the second portion 186*b* includes an aperture 186*d*, and a knob 195 includes a shaft configured and arranged to extend through the aperture 186*d* and a desired one of the apertures 198 to secure the second portion 186*b* in a desired position relative to the first portion 186*a*. A bolster pad assembly 199 is operatively connected to the second portion 186*b*.

In use, the first and second cane-shaped handles 120 and 140 are preferably positioned so that the detent assemblies are positioned within notches 130*a* and 150*a*, the mast 168 is positioned so that the spring plunger 370 extends through the aperture 175, and the first portion 186*a* is positioned so that the spring plunger 190 extends through the aperture 186*e*. The user may perform a variety of exercises, including inversion by pivoting the lap pad assembly 176 about the shaft 180*a* relative to the mast 168.

Figure 4A:
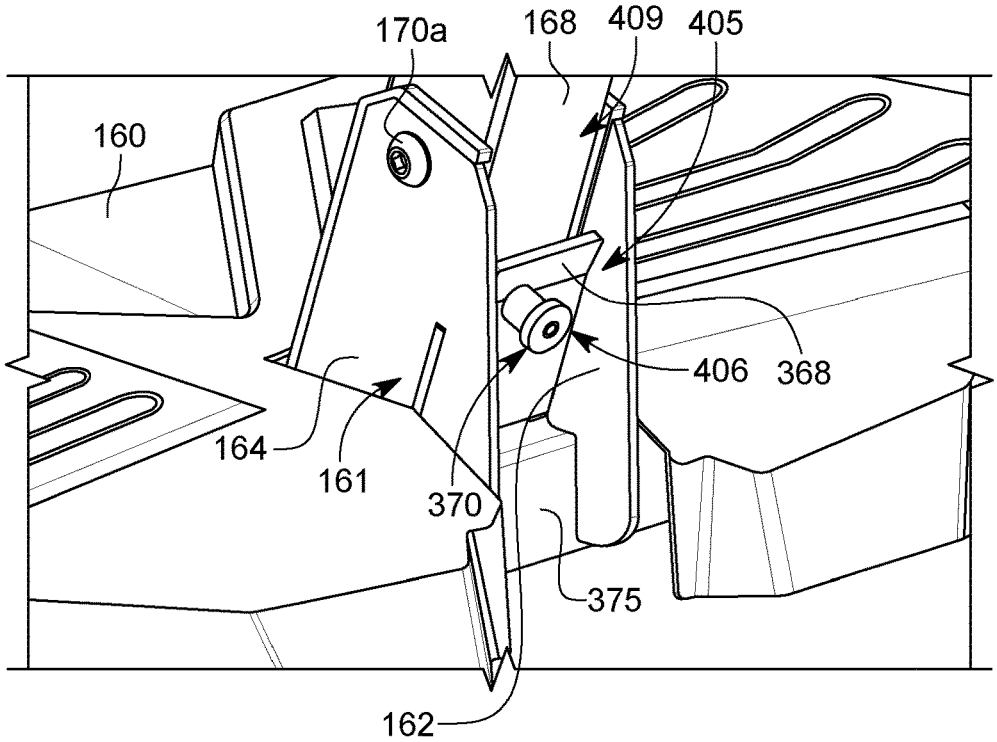
FIG. 4A is a rear perspective view of a portion of the exercise apparatus shown in FIG. 1 including a first connector assembly in a secure position.
Figure 4B:
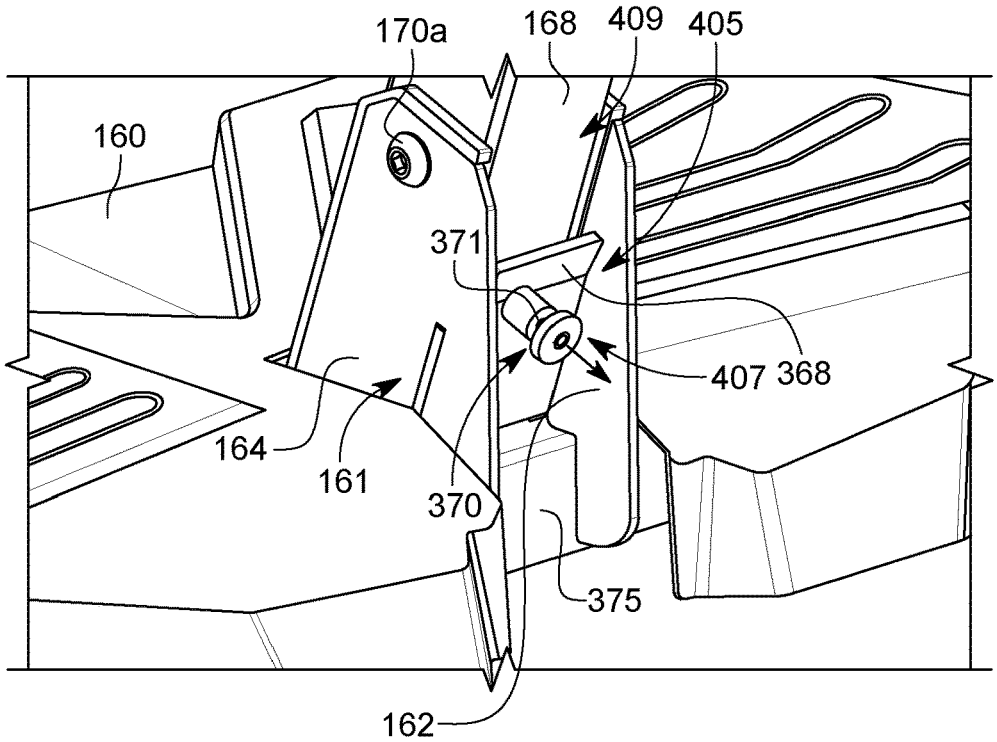
FIG. 4B is a rear perspective view of the portion of the exercise apparatus shown in FIG. 4A including the first connector assembly in a release position.
Figure 4C:
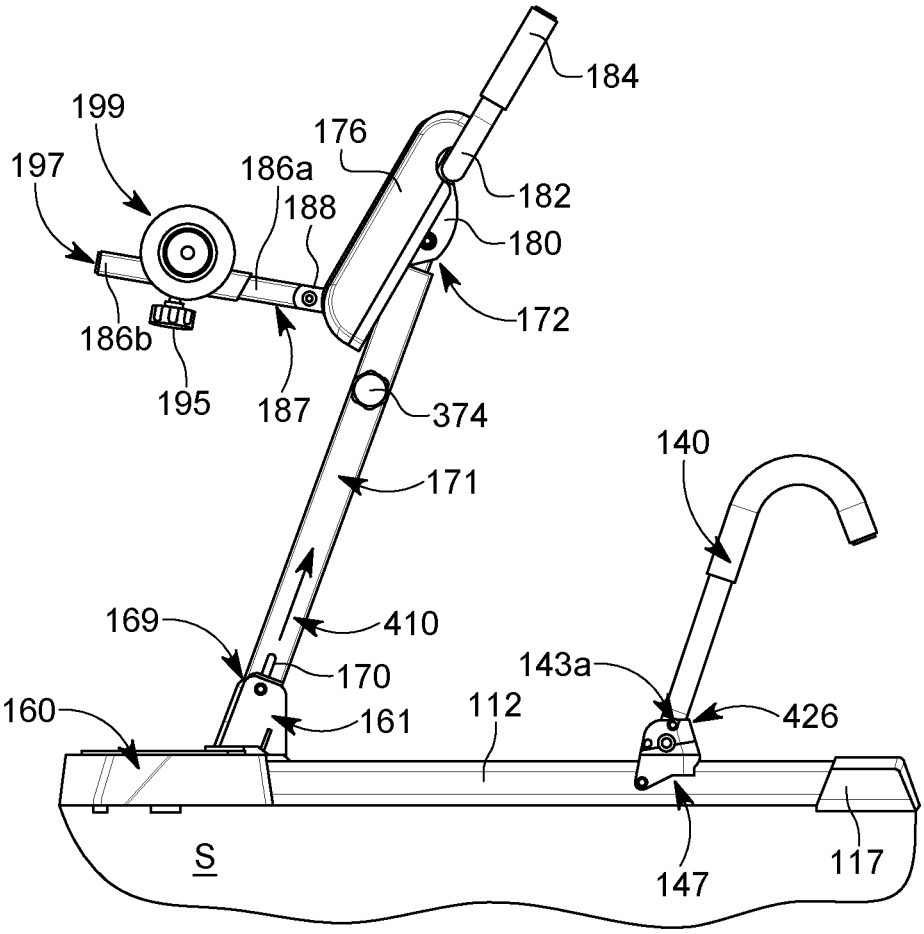
FIG. 4C is a side view of the exercise apparatus shown in FIG. 1 with a mast in a pivot position.
Figure 5:
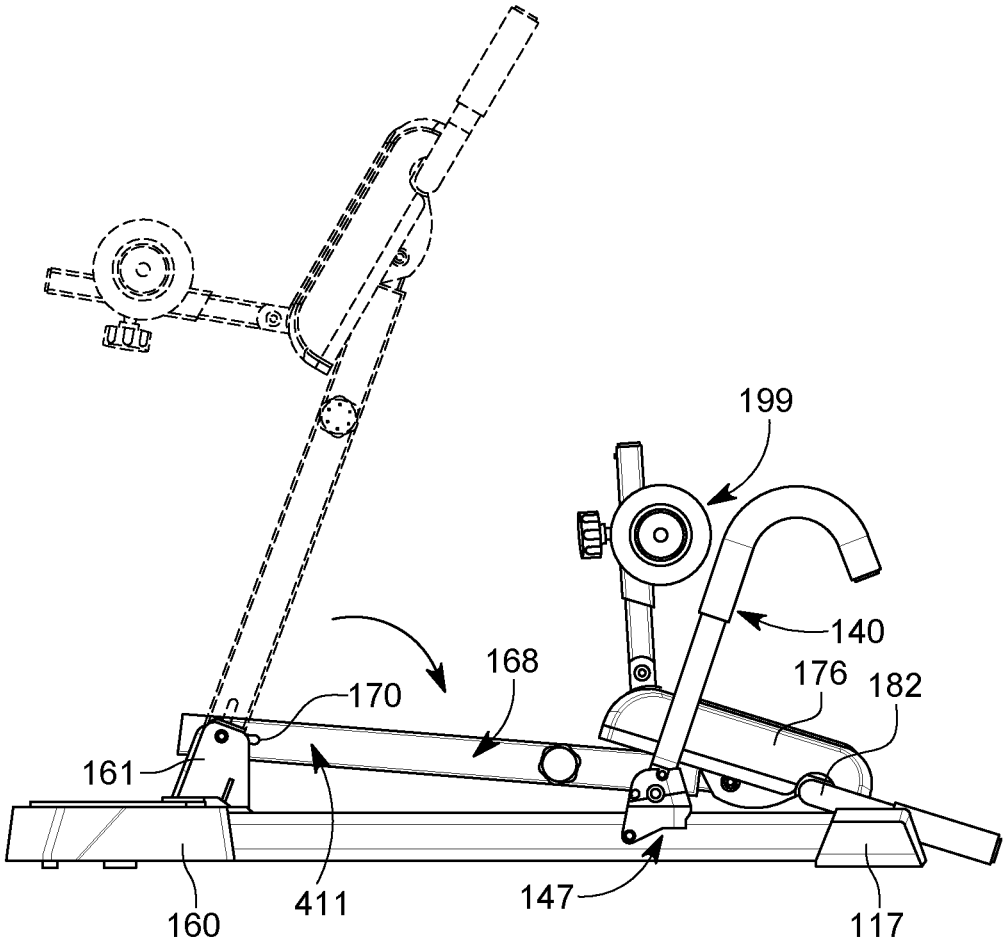
FIG. 5 is a side view of the exercise apparatus shown in FIG. 4B with the mast in a storage position.
Figure 6A:
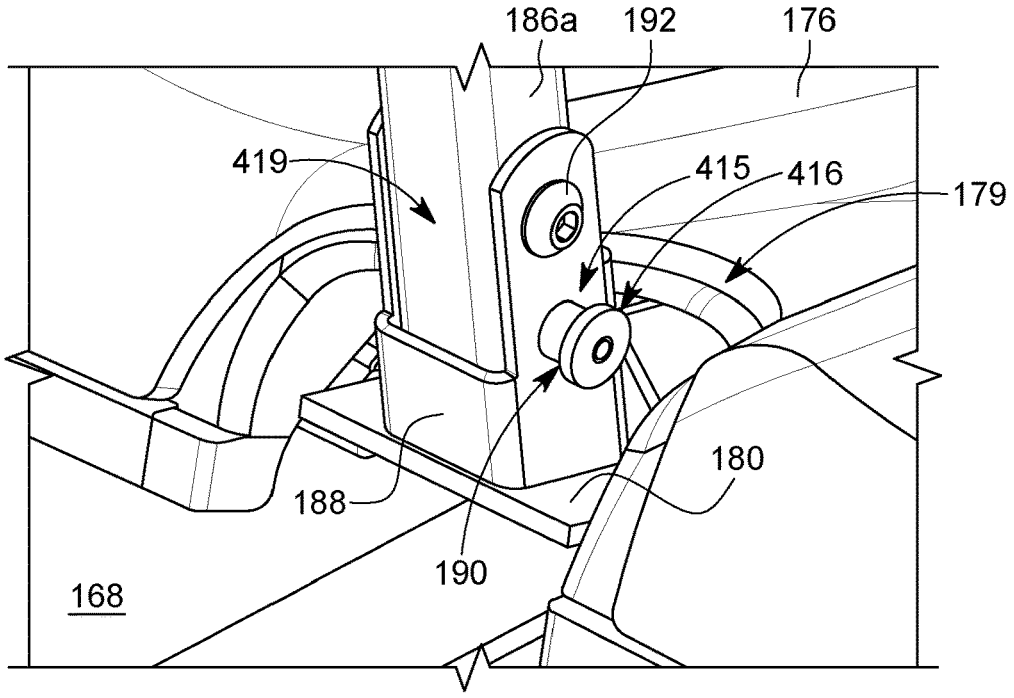
FIG. 6A is a front perspective view of a portion of the exercise apparatus shown in FIG. 1 including a second connector assembly in a secure position.
Figure 6B:
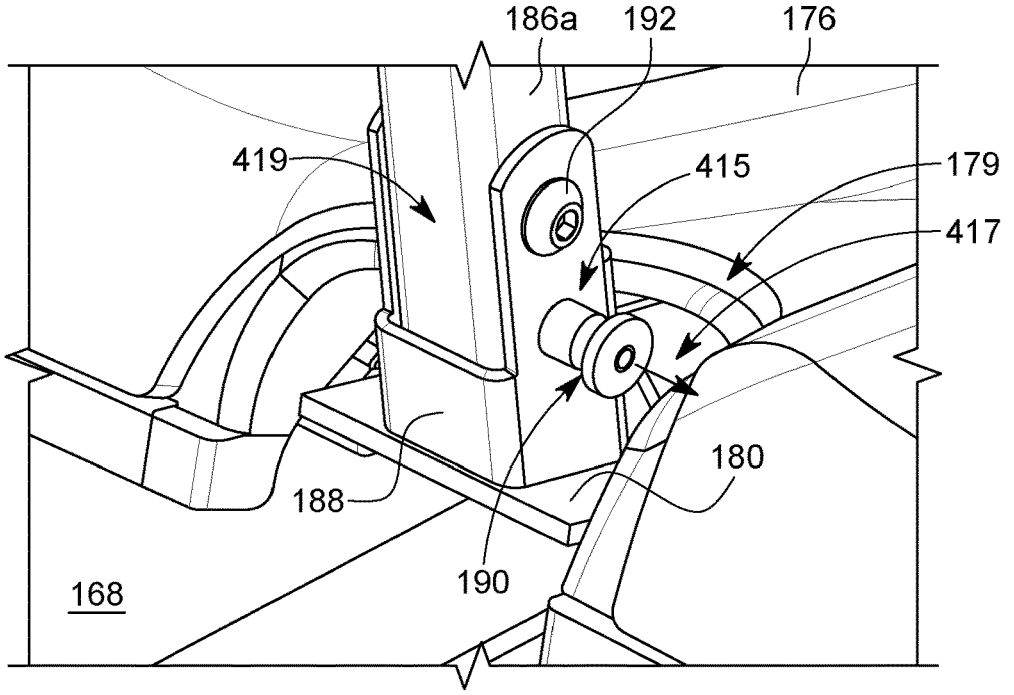
FIG. 6B is a front perspective view of the portion of the exercise apparatus shown in FIG. 6A including the second connector assembly in a release position.
Figure 6C:
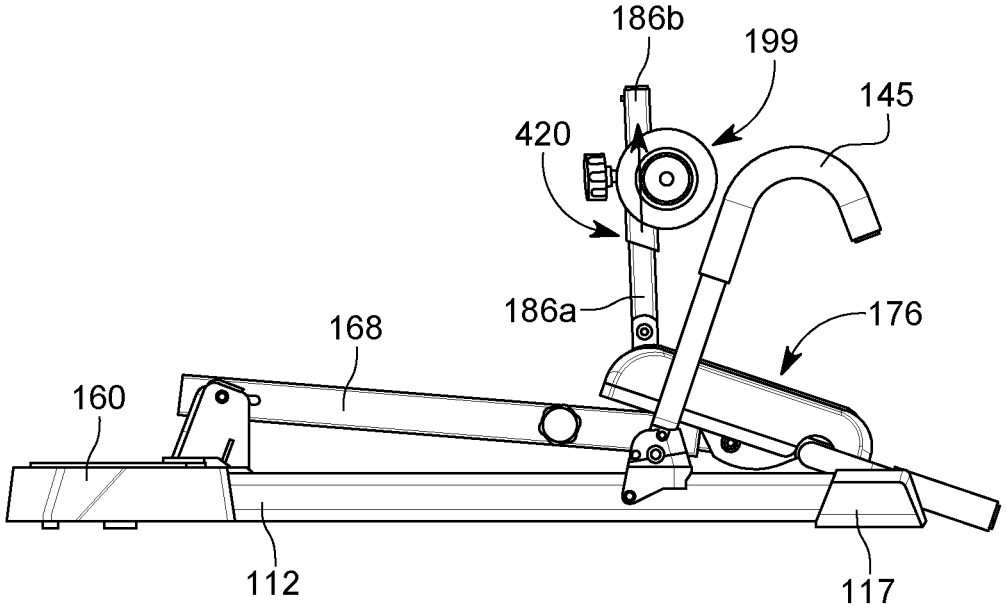
FIG. 6C is a side view of the exercise apparatus shown in FIG. 1 with a post in a pivot position.

To position the exercise apparatus 100 from a use position 401 into a storage position 403, a first connector assembly 405 is moved from a secure position 406 into a release position 407. In this embodiment, the first connector assembly 405 includes the shaft 371 of the spring plunger 370 extending through the aperture 369 of the plate 368 and selectively extending through the aperture 175 of the mast 168. As illustrated in FIGS. 4A, 4B, and 4C, the knob of the spring plunger 370 is pulled outward, thereby moving the shaft 371 out of the aperture 175 of the mast 168. The mast 168 is then able to be moved upward from an upright or use position 409 into a pivot position 410, with the fastener 170*a* being positioned proximate a proximal end of the slot 170, so that the mast 168 can clear the plate 368 when it is pivoted about the fastener 170*a* downward relative to the bracket 161. As illustrated in FIG. 5, when the mast 168 is pivoted downward and is positioned proximate the legs 104 and 112, it is in a downward or storage position 411.

Figure 7:
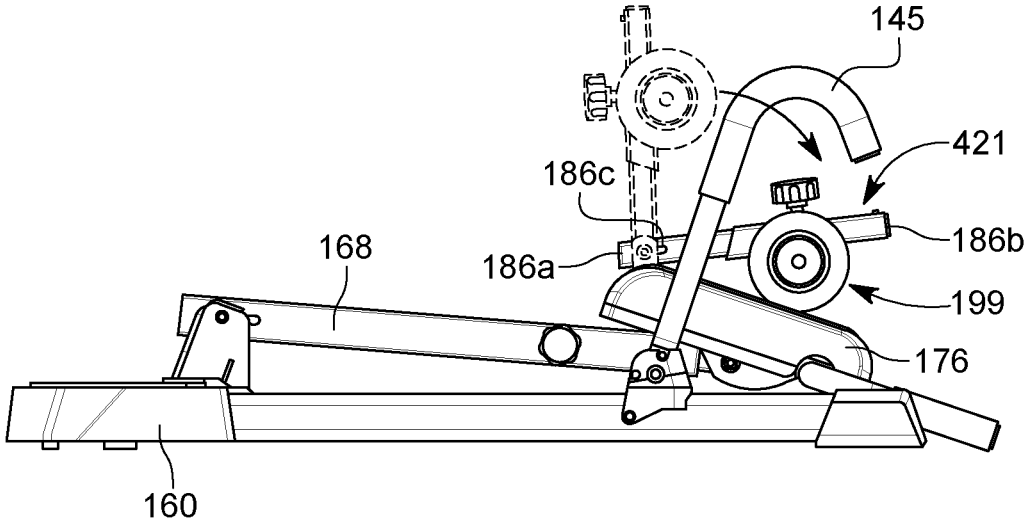
FIG. 7 is a side view of the exercise apparatus shown in FIG. 6B with the post in a storage position.

A second connector assembly 415 is moved from a secure position 416 into a release position 417. In this embodiment, the second connector assembly 415 includes the shaft (not shown) of the spring plunger 190 extending through the aperture 189 of the bracket 188 and selectively extending through the aperture 186*e* of the first post portion 186*a*. As illustrated in FIGS. FIGS. 6A, 6B, and 6C, the knob of the spring plunger 190 is pulled outward, thereby moving the shaft out of the aperture 186*e* of the first post portion 186*a*. The post 186 is then able to be moved outward from a use position 419 into a pivot position 420, with the fastener 192 being positioned proximate a proximal end of the slot 186*c*, so that the post 186 can clear the bracket 188 when it is pivoted about the fastener 192 relative to the bracket 188. As illustrated in FIG. 7, when the post 186 is pivoted toward the lap pad assembly 176, it is in a storage position 421.

Figure 8A:
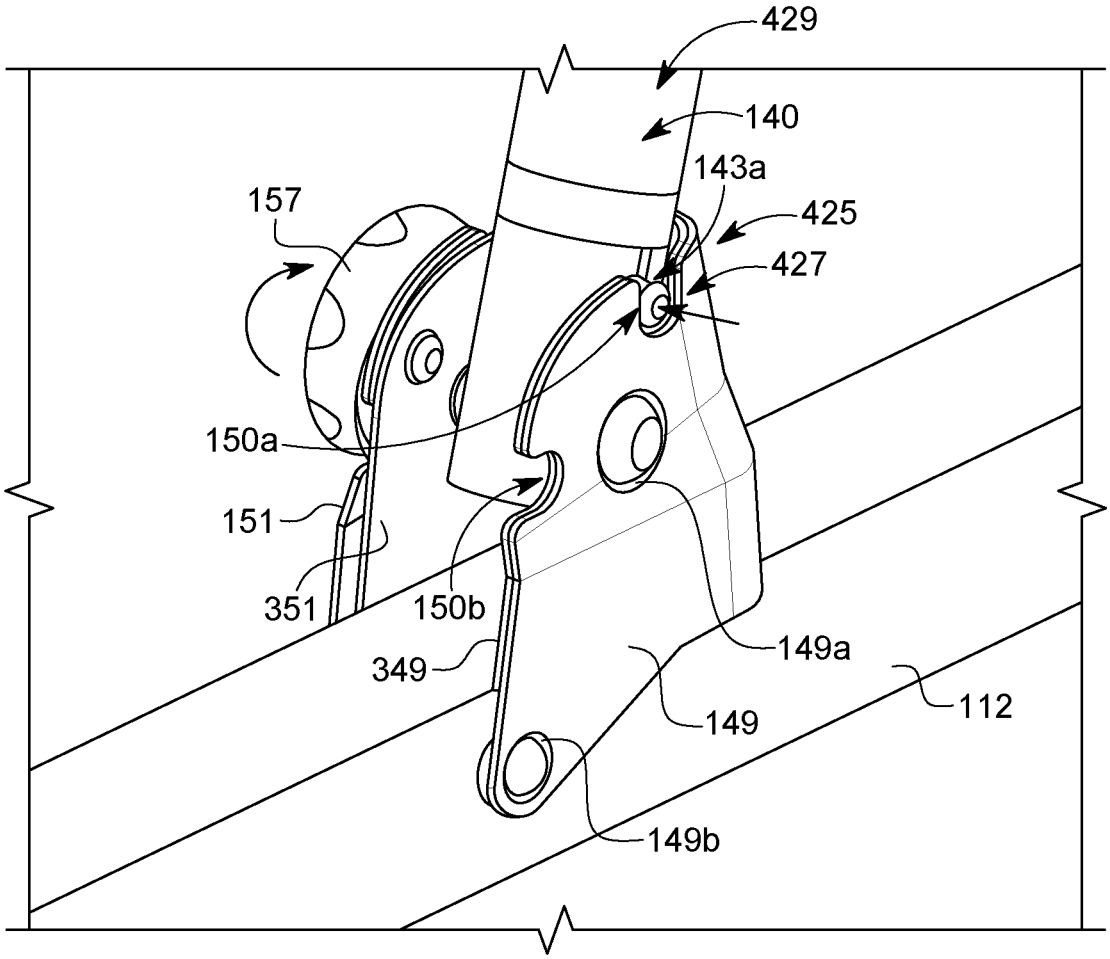
FIG. 8A is a front perspective view of a portion of the exercise apparatus shown in FIG. 1 including a third connector assembly in a release position and a cane in a pivot position.
Figure 8B:
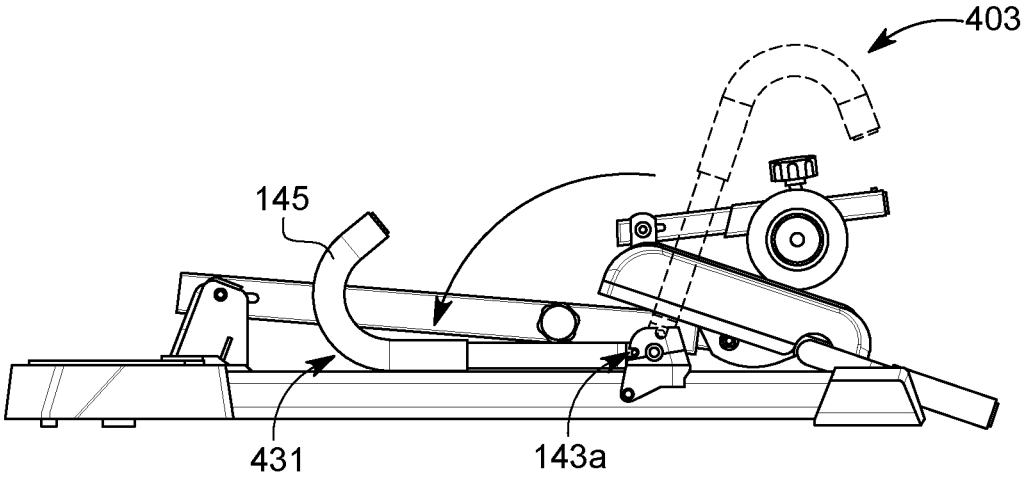
FIG. 8B is a side view of the exercise apparatus shown in FIG. 8A with the third connector assembly in a secure position and the cane in a storage position.

A third connector assembly 425 is moved from a secure position 426 into a release position 427. In this embodiment, the third connector assembly 425 includes a detent assembly operatively connected to each cane-shaped handle 120 and 140 selectively extending through notches 130*a* or 130*b* and 150*a* or 150*b* in the brackets 128 and 148. As illustrated in FIGS. 8A and 8B, one of the cane-shaped handles, handle 140 is positioned in a use position 429 when the detent assembly 143*a* is extending through notch 150*a*. The detent assembly 143*a* is pushed inward, so that it does not extend through notch 150*a*, to move the detent assembly 143*a* from the secure position 426 into the release position 427. The handle 140 can then be moved from the use position 429 into the storage position 431. When the handle 140 is in the storage position 431, the detent assembly 143*a* then extends through the notch 150*b*.

To position the exercise apparatus 100 from the storage position 403 into the use position 401, the detent assembly 143*a* is pushed inward, out of notch 150*b*, so that the handle 140 can be pivoted upward, and then the detent assembly 143*a* is spring biased to extend through notch 150*a*. The handle 120 is similarly moved. The post 186 is pivoted upward and then pushed downward so that the shaft of the spring plunger 190 extends into the slot 186*c*. The mast 168 is pivoted upward and then pushed downward so that the shaft 371 of the spring plunger 370 extends into the aperture 175.

It is recognized that the connector assemblies can be any suitable connector assemblies and can be repositioned between the secure positions and the release positions in any order.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

The invention claimed is:

1. A method of storing an exercise apparatus by moving the exercise apparatus from an apparatus use position into an apparatus storage position, comprising:

releasing a mast relative to a frame and moving the mast from an upward, mast use position to a downward, mast storage position proximate the frame positioned on a support surface; and releasing a post relative to the mast from a post use position to a post storage position, wherein after the post is released the post is moved outward and then pivoted.

2. The method of claim 1, further comprising releasing a handle relative to the frame and moving the handle from a handle use position to a handle storage position proximate the frame.

3. The method of claim 2, wherein the frame includes a leg supported by the support surface and the handle is positioned proximate the leg in the handle storage position.

4. The method of claim 2, wherein the handle is released by pushing a detent assembly to disengage a bracket.

5. The method of claim 2, further comprising loosening a de-rattler knob operatively connected to the handle.

6. The method of claim 1, wherein a lap pad assembly is operatively connected to a distal end of the mast and is positioned proximate the frame in the mast storage position.

7. The method of claim 1, wherein the frame includes a leg supported by the support surface and the mast is positioned proximate the leg in the mast storage position.

8. The method of claim 1, wherein the mast is released by moving a mast spring plunger out of engagement with the mast.

9. The method of claim 1, wherein after the mast is released the mast is moved in an upward direction and then pivoted downward.

10. The method of claim 1, wherein a lap pad assembly is operatively connected to a distal end of the mast and is positioned proximate the frame in the mast storage position, and wherein a bolster pad assembly is operatively connected to the post and is positioned proximate the lap pad assembly in the post storage position.

11. The method of claim 1, wherein the post is released by moving a post spring plunger out of engagement with the post.

12. A method of storing an exercise apparatus by moving the exercise apparatus from a use position into a storage position, comprising:

releasing a mast relative to a frame and moving the mast from an upward, mast use position to a downward, mast storage position proximate the frame positioned on a support surface;

releasing a post relative to the mast from a post use position to a post storage position, wherein the post is released by moving a mast spring plunger out of engagement with the mast, and wherein after the post is released the post is moved outward and then pivoted; and releasing a handle relative to the frame and moving the handle from a handle use position to a handle storage position proximate the frame.

13. The method of claim 12, wherein a lap pad assembly is operatively connected to a distal end of the mast and is positioned proximate the frame in the mast storage position, and wherein the frame includes a leg supported by the support surface and the mast is positioned proximate the leg in the mast storage position.

14. The method of claim 12, wherein the mast is released by moving a mast spring plunger out of engagement with the mast, and wherein after the mast is released the mast is moved in an upward direction and then pivoted downward.

15. The method of claim 12, wherein the frame includes a leg supported by the support surface and the handle is positioned proximate the leg in the handle storage position.

16. The method of claim 12, wherein the handle is released by pushing a detent assembly to disengage a bracket.

17. The method of claim 12, further comprising loosening a de-rattler knob operatively connected to the handle.

18. A method of storing an exercise apparatus by moving the exercise apparatus from an apparatus use position into an apparatus storage position, comprising:

releasing a mast relative to a frame and moving the mast from an upward, mast use position to a downward, mast storage position proximate the frame positioned on a support surface, wherein the mast is released by moving a mast spring plunger out of a mast aperture and then the mast is moved in an upward direction and then pivoted downward about a mast fastener extending through a mast slot in the mast; and releasing a post relative to the mast from a post use position to a post storage position, wherein after the post is released the post is moved outward and then pivoted proximate the mast and the frame.

19. The method of claim 18, wherein the post is released by moving a post spring plunger out of engagement with the post, and wherein after the post is released the post is moved outward and then pivoted about a post fastener extending through a post slot in the post.

* * * * *